US009641928B2

(12) United States Patent
Tanaka et al.

(10) Patent No.: US 9,641,928 B2
(45) Date of Patent: May 2, 2017

(54) MICROPHONE ARRAY CONTROL APPARATUS AND MICROPHONE ARRAY SYSTEM

(71) Applicant: PANASONIC INTELLECTUAL PROPERTY MANAGEMENT CO., LTD., Osaka (JP)

(72) Inventors: Koshi Tanaka, Fukuoka (JP); Shinichi Shigenaga, Tokyo (JP); Ryota Fujii, Fukuoka (JP); Masanari Miyamoto, Fukuoka (JP); Kazuyuki Horio, Fukuoka (JP); Yuji Abe, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 10 days.

(21) Appl. No.: 14/797,597

(22) Filed: Jul. 13, 2015

(65) Prior Publication Data

US 2016/0014506 A1 Jan. 14, 2016

(30) Foreign Application Priority Data

Jul. 14, 2014 (JP) ..... 2014-144362

(51) Int. Cl.
*H04R 1/40* (2006.01)
*H04R 3/00* (2006.01)
*G10L 21/0216* (2013.01)

(52) U.S. Cl.
CPC ..... *H04R 1/406* (2013.01); *H04R 3/005* (2013.01); *G10L 2021/02166* (2013.01); *H04R 2201/401* (2013.01)

(58) Field of Classification Search
CPC .. H04R 1/406; H04R 3/005; H04R 2201/401; H04R 2201/403; H04R 2430/23; G10L 2021/02166
See application file for complete search history.

(56) References Cited

U.S. PATENT DOCUMENTS

2001/0002467 A1 5/2001 Ogo
2002/0069054 A1* 6/2002 Arrowood ..... G10L 21/0208 704/233

(Continued)

FOREIGN PATENT DOCUMENTS

EP 0694833 1/1996
JP 8-106374 4/1996

(Continued)

*Primary Examiner* — Mark Fischer
(74) *Attorney, Agent, or Firm* — Greenblum & Bernstein, P.L.C.

(57) ABSTRACT

A sound collecting control apparatus includes: a vehicle stop detector; a noise source direction specifier to specify a direction from the sound collector to a noise source of the vehicle stopped at the predetermined position; a search beam former that forms a plurality of search beams in the direction of the noise source specified by the noise source direction specifier and around the direction of the noise source so as to search for a sound source of a voice of a speaker in the vehicle; a search beam selector that selects a search beam corresponding to the sound source of the voice of the speaker in the vehicle from the plurality of search beams formed by the search beam former; and a directivity former that forms directivity of the sound collected by the sound collector in the direction corresponding to the search beam selected by the search beam selector.

17 Claims, 13 Drawing Sheets

(56) References Cited

U.S. PATENT DOCUMENTS

| | | | | |
|---|---|---|---|---|
| 2005/0140810 | A1 | 6/2005 | Ozawa | |
| 2008/0285771 | A1* | 11/2008 | Tanaka | H04M 3/56 381/92 |
| 2014/0063263 | A1* | 3/2014 | Bernal | H04N 5/23296 348/169 |
| 2015/0350769 | A1* | 12/2015 | Sun | G06K 9/00221 348/14.08 |

FOREIGN PATENT DOCUMENTS

| | | |
|---|---|---|
| JP | 2001-155259 | 6/2001 |
| JP | 2005-124090 | 5/2005 |
| JP | 2010-16564 | 1/2010 |

* cited by examiner

MICROPHONE ARRAY CONTROL APPARATUS AND MICROPHONE ARRAY SYSTEM

BACKGROUND

1. Technical Field

The present disclosure relates to a microphone array control apparatus and a microphone array system that form the directivity of sound in a direction toward a speaker by using sound collected by a plurality of microphone elements.

2. Description of the Related Art

An order input apparatus including a microphone and a loudspeaker is disposed near the position of a vehicle stopped at a drive-through of stores such as a fast-food store or a cafe so that a staff wearing a headset in the store communicates the order content with a speaker (for example, an order placer) who visits the store by vehicle (for example, an automobile). The microphone used in the order input apparatus is a single non-directional microphone or a directional microphone of which the directivity is formed in advance in a predetermined direction. Thus, the sound of the order content collected may be inaccurate due to the sound of the vehicle engine or depending on the surrounding environment.

A sound signal processing apparatus disclosed in Japanese Patent Unexamined Publication No. 2010-16564 is suggested as a preceding technology related to a sound signal processing apparatus in the drive-through system that is provided with an echo canceller which removes echo components generated when the voice of the staff is collected by the microphone in the backward direction.

An echo canceller of the sound signal processing apparatus disclosed in Japanese Patent Unexamined Publication No. 2010-16564, given that the customer side of the drive-through is defined as a near-end side, and the staff side thereof is defined as a far-end side, includes an adaptive filter and a coefficient update controller. The adaptive filter generates a pseudo-echo signal on the basis of a far-end signal. The coefficient update controller causes echo canceller coefficients of the adaptive filter to converge through a coefficient update process. When arrival of the vehicle is detected as a change in the near-end sound collecting environment, the echo canceller changes the coefficient update process so as to decrease the speed of convergence of the echo canceller coefficients according to the passage of time after the detection. The echo canceller decreases the step size of NLMS (learning identification) according to the passage of time and switches the algorithm of the coefficient update process from, for example, recursive least squares (RLS) method to normalized least means squares (NLMS) method so as to decrease, for example, the speed of convergence.

In the drive-through system using a single microphone, however, a problem arises in that it is hard for the staff to listen to the order content of the speaker because the volume of the sound of the vehicle (for example, an automobile) engine is great at a location immediately close to the speaker (for example, an order placer). Furthermore, when noise from a surrounding road, an expressway, or a railroad is great, it is harder for the staff to listen to the order content of the speaker. In addition, the staff may have difficulty in listening to the order content of the speaker depending on whether the vehicle is separated from a predetermined stop position or depending on the different heights of vehicles (for example, automobiles).

SUMMARY

According to an aspect of the present disclosure, there is provided a sound collecting control apparatus including a vehicle stop detector that detects a vehicle being stopped at a predetermined position, a noise source direction specifier that uses sound collected by a sound collector including a plurality of sound collecting elements to specify a direction from the sound collector to a noise source of the vehicle stopped at the predetermined position, a search beam former that forms a plurality of search beams in the direction of the noise source of the vehicle specified by the noise source direction specifier and around the direction of the noise source of the vehicle so as to search for a sound source of a voice of a speaker in the vehicle, a search beam selector that selects a search beam corresponding to the sound source of the voice of the speaker in the vehicle from the plurality of search beams formed by the search beam former, and a directivity former that forms directivity of the sound collected by the sound collector in the direction corresponding to the search beam selected by the search beam selector.

According to another aspect of the present disclosure, there is provided a sound collecting control apparatus including a vehicle stop detector that detects a vehicle stopped at a predetermined position, a search beam former that forms a plurality of search beams in any of a horizontal direction, a vertical direction, and horizontal and vertical directions from the direction of a predetermined reference beam corresponding to a sound source of a voice of a speaker in the vehicle so as to search for the sound source of the voice of the speaker in the vehicle at each predetermined angle, a search beam selector that selects a search beam corresponding to the sound source of the voice of the speaker in the vehicle from the plurality of search beams formed by the search beam former, and a directivity former that forms directivity of sound collected by a sound collector including a plurality of sound collecting elements in the direction corresponding to the search beam selected by the search beam selector in which the search beam former may form a plurality of search beams at each angle smaller than the predetermined angle around the search beam that corresponds to the sound source of the voice of the speaker in the vehicle and may be selected by the search beam selector, and the search beam selector may select the search beam corresponding to the sound source of the voice of the speaker in the vehicle from the plurality of search beams formed at each angle smaller than the predetermined angle.

According to still another aspect of the present disclosure, there is provided a sound collecting system including a sound collector that includes a plurality of sound collecting elements and collects a voice of a speaker in a vehicle, a vehicle stop detector that detects the vehicle stopped at a predetermined position, a noise source direction specifier that uses sound collected by the sound collector to specify a direction from the sound collector to a noise source of the vehicle stopped at the predetermined position, a search beam former that forms a plurality of search beams in the direction of the noise source of the vehicle specified by the noise source direction specifier and around the direction of the noise source of the vehicle so as to search for a sound source of a voice of a speaker in the vehicle, a search beam selector that selects a search beam corresponding to the sound source of the voice of the speaker in the vehicle from the plurality of search beams formed by the search beam former, and a directivity former that forms directivity of the sound collected by the sound collector in the direction corresponding to the search beam selected by the search beam selector.

According to still another aspect of the present disclosure, there is provided a sound collecting system including a sound collector that includes a plurality of sound collecting elements and collects a voice of a speaker in a vehicle, a vehicle stop detector that detects a vehicle stopped at a predetermined position, a search beam former that forms a plurality of search beams in any of a horizontal direction, a vertical direction, and horizontal and vertical directions from the direction of a predetermined reference beam corresponding to a sound source of a voice of a speaker in the vehicle so as to search for the sound source of the voice of the speaker in the vehicle at each predetermined angle, a search beam selector that selects a search beam corresponding to the sound source of the voice of the speaker in the vehicle from the plurality of search beams formed by the search beam former, and a directivity former that forms directivity of the sound collected by the sound collector in the direction corresponding to the search beam selected by the search beam selector in which the search beam former may form a plurality of search beams at each angle smaller than the predetermined angle around the search beam that may correspond to the sound source of the voice of the speaker in the vehicle and is selected by the search beam selector, and the search beam selector may select the search beam corresponding to the sound source of the voice of the speaker in the vehicle from the plurality of search beams formed at each angle smaller than the predetermined angle.

According to the aspects of the present disclosure, it is possible to suppress a decrease in accuracy of collecting a voice of a speaker by forming the directivity of sound collected by a plurality of microphone elements in a direction toward the speaker, and it is possible to facilitate listening to the order content of the speaker by a staff in a store.

BRIEF DESCRIPTION OF DRAWINGS

FIG. 1 is a schematic descriptive diagram of a state where the voice of a speaker (an order placer) is collected in a sound collecting system of an embodiment applied to a drive-through;

DETAILED DESCRIPTION OF THE PREFERRED EMBODIMENT

Hereinafter, an exemplary embodiment of a microphone array control apparatus and a microphone array system according to the present disclosure (hereinafter, referred to as the "present exemplary embodiment") will be described with reference to the drawings. The sound collecting system of the present exemplary embodiment will be described as being used at a drive-through in stores such as a fast-food store or a cafe but is not limited to the example applied to the drive-through.

The present disclosure may also be represented as a method that includes various operations (steps) that each device constituting the sound collecting system (for example, later-described communication system master machines 10 and 10A and signal processing device 20) or the sound collecting system performs.

Figure 1:
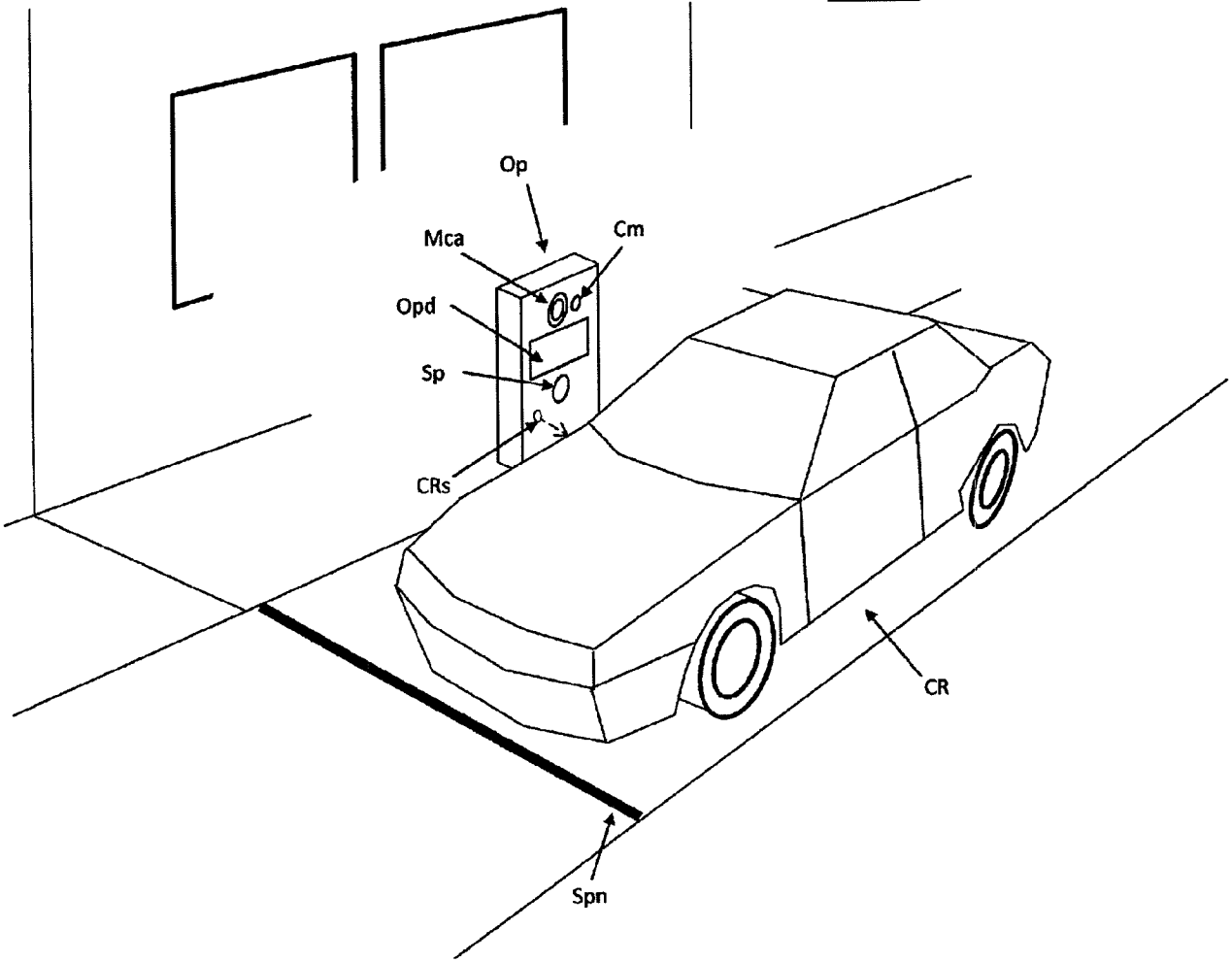

FIG. 1 is a schematic descriptive diagram of a state where the voice of a speaker (an order placer) is collected in sound collecting system 100 of the present exemplary embodiment applied to a drive-through. In sound collecting system 100 illustrated in FIG. 1, a visitor (hereinafter, referred to as an "order placer") who visits a store (for example, a fast-food store) by vehicle (for example, an automobile) CR speaks to order post Op installed outside the store so as to communicate the order content with the staff inside the store at the drive-through.

In the present exemplary embodiment, order post Op is an outside-installed apparatus that displays a product to order at the drive-through on order post display Opd by using image data such as a picture and includes at least microphone array device Mca and speaker device Sp so as to perform communication between the staff and the visitor (order placer). Microphone array device Mca will be described later.

Speaker device Sp, for example, outputs the voice uttered by the staff in the store. For example, the voice of the staff (for example, "Welcome. May I have your order, please?") is output from speaker device Sp of order post Op through communication system master machine (base unit) 10 (refer to the description provided later), and the order placer hears the voice. The voice of the order placer (for example, the name and the quantity of a product to order) is collected by microphone array device Mca of order post Op and is output through communication system master machine 10 (refer to the description provided later) to headset Hds that the staff wears (refer to FIG. 2A or FIG. 2B).

Order post Op is provided with camera device Cm. Camera device Cm captures an image within the range of a predetermined angle of view including the front direction of order post Op. The image captured by camera device Cm is displayed on later-described display device 36 (refer to FIG. 3 or FIG. 4).

Order post Op is provided with vehicle detection sensor CRs. Vehicle detection sensor CRs detects vehicle CR stopped at a predetermined stop position (for example, in front of stop line Spn, the same applies hereinafter) in the drive-through outside the store. Camera device Cm may detect vehicle CR stopped at a predetermined stop position in the drive-through outside the store instead of vehicle detection sensor CRs. In this case, vehicle detection sensor CRs may be omitted.

Figure 2A:
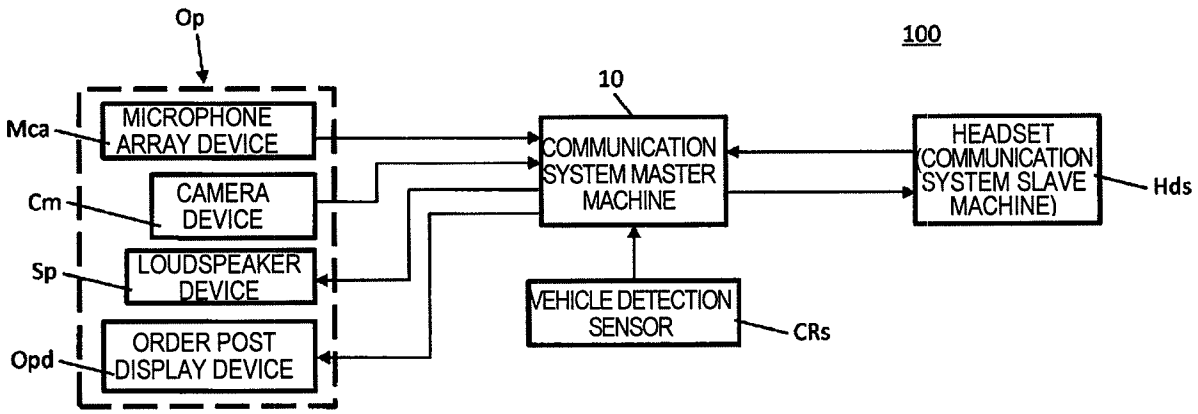
FIG. 2A is a block diagram of a first example of a system configuration of the sound collecting system in the embodiment.
Figure 2B:
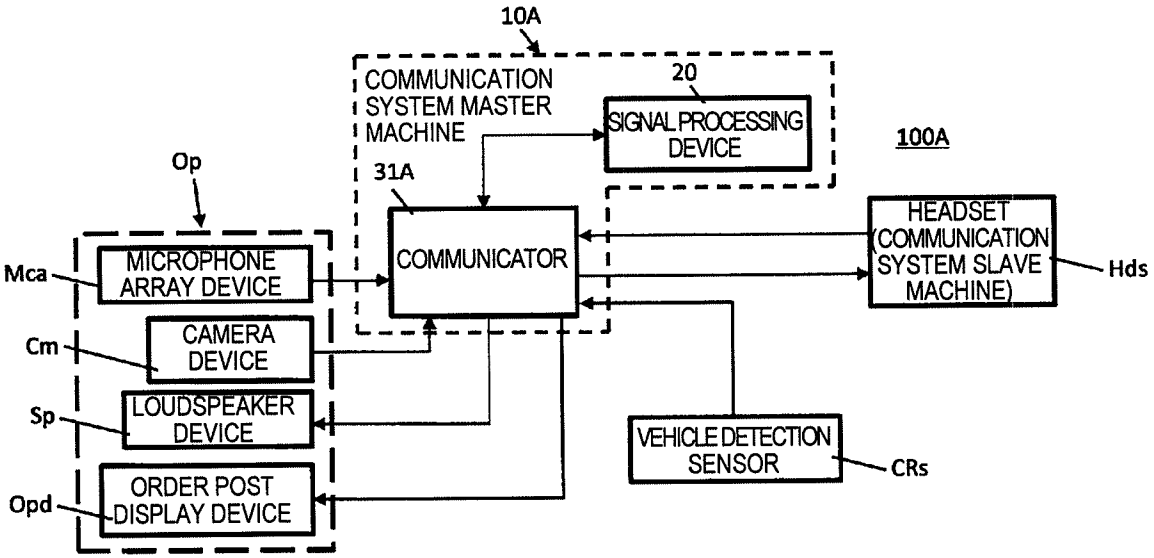
FIG. 2B is a block diagram of a second example of a system configuration of the sound collecting system in the embodiment.

FIG. 2A is a block diagram of a first example of a system configuration of sound collecting system 100 in the exemplary embodiment. FIG. 2B is a block diagram of a second example of a system configuration of sound collecting system 100A in the exemplary embodiment. Details of the system configuration of sound collecting system 100 illustrated in FIG. 2A will be described with reference to FIG. 3, and details of the system configuration of sound collecting system 100A illustrated in FIG. 2B will be described with reference to FIG. 4.

Sound collecting system 100 illustrated in FIG. 2A is configured to include order post Op, communication system master machine 10, vehicle detection sensor CRs, and headset Hds as a communication system slave machine (cordless headset) with respect to communication system master machine 10. As illustrated in FIG. 1, vehicle detection sensor CRs may be disposed as being included in order post Op or may be disposed outside order post Op.

Connections are mutually provided between order post Op and communication system master machine 10, between vehicle detection sensor CRs and communication system master machine 10, and between headset Hds and communication system master machine 10 through an unillustrated network. The network may be a wired network (for example, an intranet or the Internet) or may be a wireless network (for example, a wireless local area network (LAN)).

Microphone array device Mca as an example of a sound collector includes a plurality of sound collecting elements (for example, microphone elements). Each microphone element collects sound in a sound collecting area where sound collecting system 100 is installed (for example, the range of a predetermined angle from the front of order post Op in a horizontal direction (left-right direction)). A high-quality small-size electret condenser microphone (ECM), for example, is used as the microphone element.

Microphone array device Mca, for example, collects the sound of the order content of the visitor (order placer) who visits the store by vehicle CR or noise due to the sound of the engine (hereinafter, referred to as "engine noise") as an example of a noise source of vehicle CR. A sound signal of the sound collected by microphone array device Mca, an image signal obtained after capture by camera device Cm, and a detection signal including the result of detection of vehicle CR stopped at a predetermined position by vehicle detection sensor CRs are transmitted to communication system master machine 10.

Each microphone element of microphone array device Mca may be a non-directional microphone or may be a bidirectional microphone, a unidirectional microphone, a sharply directional microphone, or a super directional microphone (for example, a gun microphone) or a combination thereof. Instead of microphone array device Mca, a configuration including a plurality of microphones that has a mechanism operable in accordance with a predetermined control signal may be used as an example of the sound collector in the present exemplary embodiment.

Communication system master machine 10 illustrated in FIG. 2A may be configured of communicator 31A and signal processing device 20 as illustrated in FIG. 2B. Communicator 31A has a role of providing a communication function between order post Op, headset Hds, and vehicle detection sensor CRs. Signal processing device 20 has a role other than the communication function (refer to the description provided later for details). The sound collecting control apparatus according to the present disclosure may correspond to communication system master machine 10 illustrated in FIG. 2A or may correspond to signal processing device 20 illustrated in FIG. 2B. Hereinafter, the sound collecting control apparatus according to the present disclosure will be described as communication system master machine 10 illustrated in FIG. 2A for simplification of description.

Camera device Cm captures an image within the range of a predetermined angle of view including the front direction of order post Op and transmits image data (for example, two-dimensional image data that is generated after being panoramically converted by performing a predetermined distortion correction process) obtained after the capture to communication system master machine 10 or communicator 31A. As described above, camera device Cm may detect vehicle CR stopped at a predetermined stop position in the drive-through outside the store by performing a predetermined image analysis process on the image data of the image that camera device Cm itself captures.

Camera device Cm, as will be described later with reference to FIG. 9, receives coordinates data of a position specified in an image from communication system master machine 10, when an arbitrary position is specified by a user on the image displayed on the display device 36. Camera device Cm computes distance data from camera device Cm to the position in the real-world space corresponding to the specified position (hereinafter, referred to as a "sound collecting position") and direction data (includes a horizontal angle and a vertical angle, the same applies hereinafter) and transmits the distance data and the direction data to communication system master machine 10. A process for computing the distance data and the direction data in camera device Cm is a known technology and thus will not be described.

Order post display device Opd is configured by using, for example, a liquid crystal display (LCD) or an organic electroluminescence (EL). Order post display device Opd displays the image data of products to order in the drive-through (for example, food and drink) and the total price of ordered products under control of communication system master machine 10.

Headset Hds has a role as a communication system slave machine with respect to communication system master machine 10 and is worn by the staff in the store. Headset Hds outputs a sound signal that is generated after a predetermined signal processing (refer to the description provided later) is performed by communication system master machine 10 on the voice uttered by the order placer (for example, a voice when saying the order content). Accordingly, since the voice signal of which the directivity is formed in a direction toward the sound source of the voice of the order placer in vehicle CR from microphone array device Mca is output from headset Hds after a predetermined signal processing is performed by communication system master machine 10 on the voice uttered by the order placer that is collected in microphone array device Mca, the staff wearing headset Hds can accurately listen to the voice uttered by the order placer even in an environment where the engine noise is loud. Details of the signal processing by communication system master machine 10 will be described later.

Figure 3:
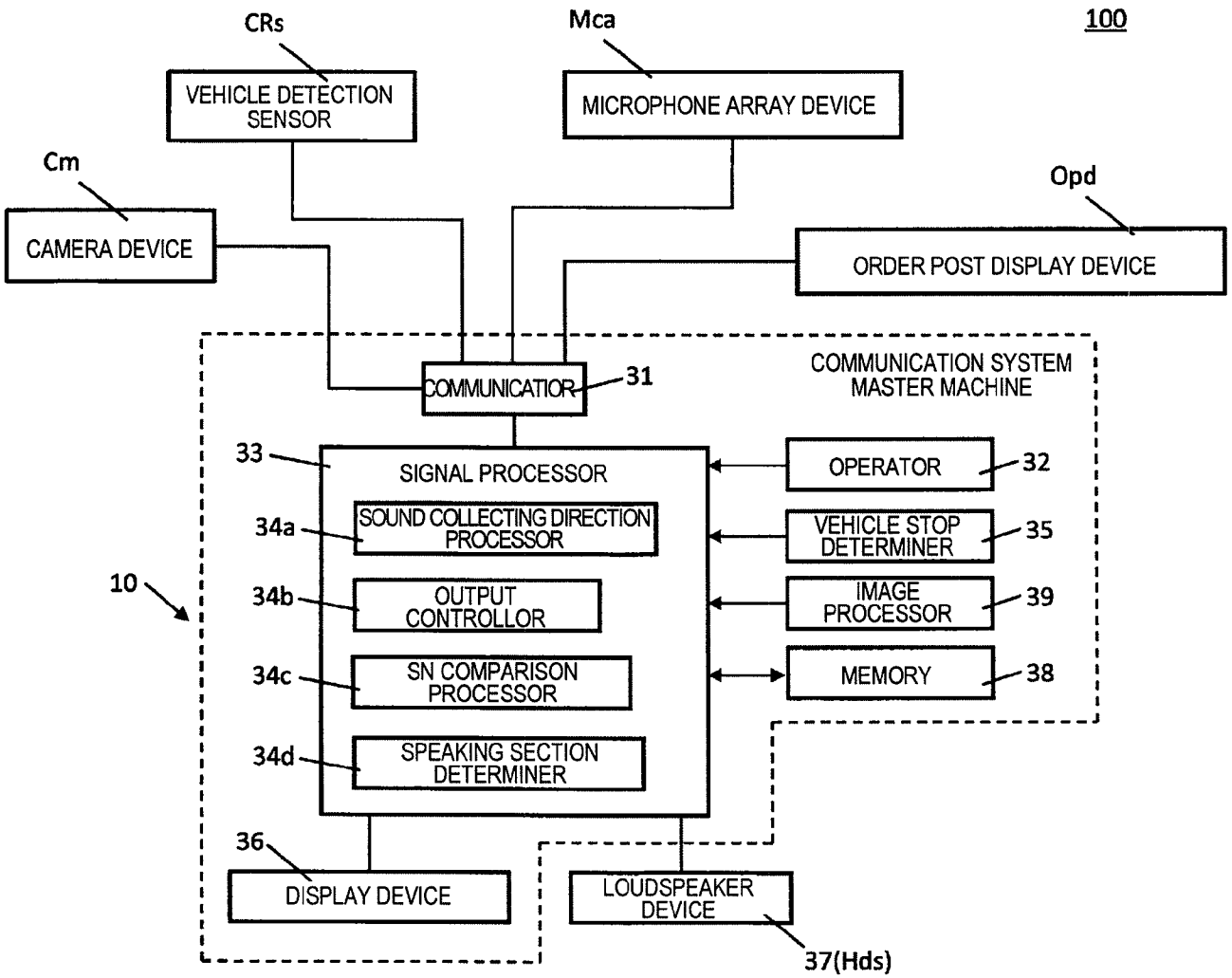
FIG. 3 is a detailed block diagram of an internal configuration of a communication system master machine in the sound collecting system illustrated in FIG. 2A.
Figure 4:
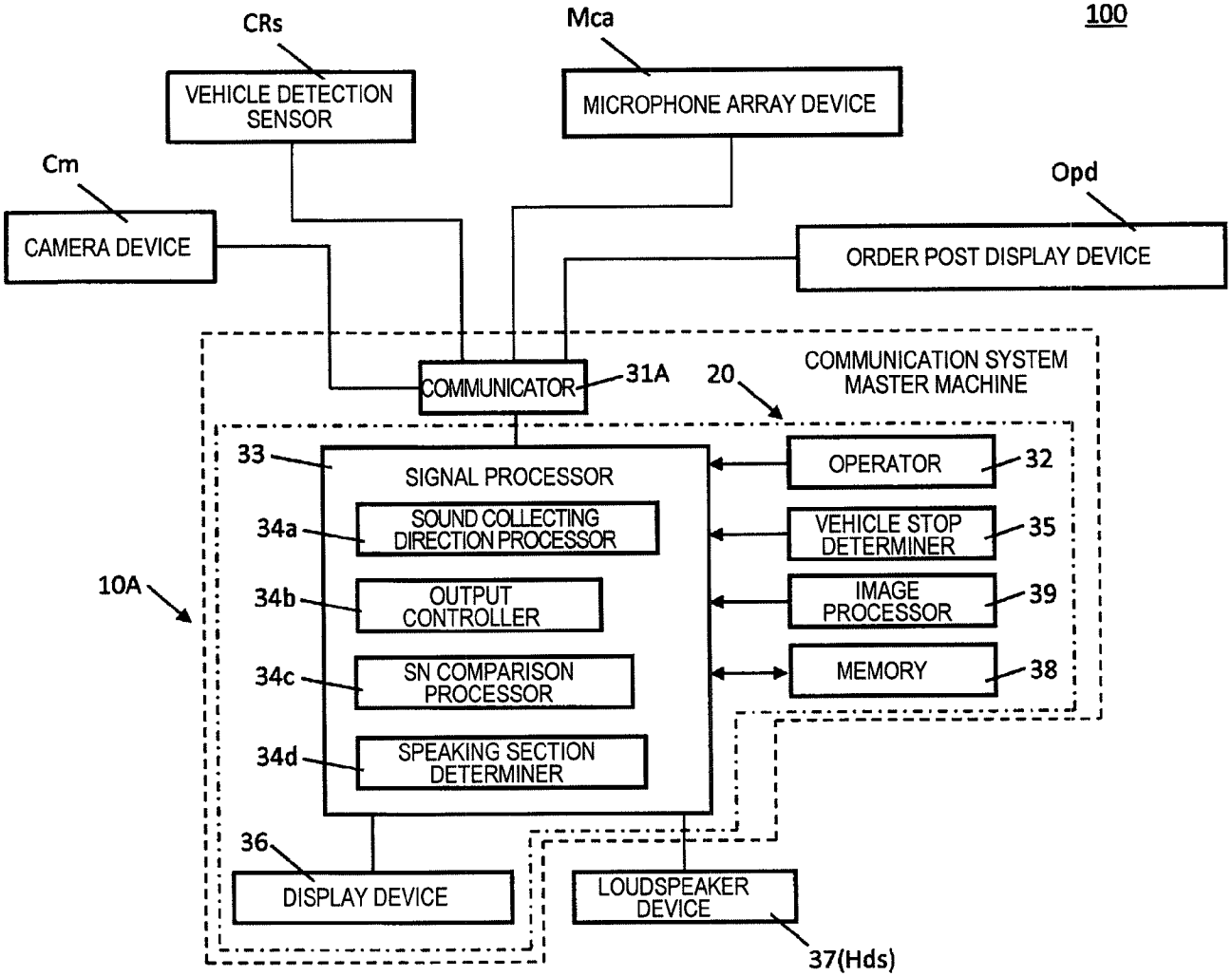
FIG. 4 is a detailed block diagram of an internal configuration of a communication system master machine in the sound collecting system illustrated in FIG. 2B.

FIG. 3 is a detailed block diagram of an internal configuration of communication system master machine 10 in sound collecting system 100 illustrated in FIG. 2A. FIG. 4 is a detailed block diagram of an internal configuration of communication system master machine 10A in sound collecting system 100A illustrated in FIG. 2B. Communication system master machine 10 illustrated in FIG. 3 is configured to include communicator 31, operator 32, signal processor 33, vehicle stop determiner 35, display device 36, memory 38, and image processor 39. Signal processor 33 is configured to include sound collecting direction processor 34*a*, output controller 34*b*, SN comparison processor 34*c*, and speaking section determiner 34*d*. Loudspeaker device 37 is not included in each of communication system master machines 10 and 10A in FIG. 3 and FIG. 4. However, when loudspeaker device 37 is a loudspeaker device that is different from headset Hds, loudspeaker device 37 may be included in communication system master machines 10 and 10A. Communication system master machines 10 and 10A, for example, may be stationary personal computers (PC) that are installed in a predetermined sound collecting control room (not illustrated) of the store or may be data communication terminals such as a cellular phone that the staff can carry, a tablet terminal, and a smartphone.

Communicator 31 receives the sound signal transmitted from microphone array device Mca, the image signal transmitted from camera device Cm, and the detection signal transmitted from vehicle detection sensor CRs and outputs the signals to signal processor 33 through an unillustrated network.

Operator 32 is a user interface (UI) so as to notify signal processor 33 of the content of an input operation by the staff and is a pointing device such as a mouse or a keyboard. Operator 32, for example, may be configured by using a touch panel or a touchpad that is arranged in correspondence with a screen of display device 36 and is operable with a finger of the user or a stylus pen.

Operator 32 obtains coordinates data indicating the position specified through an input operation by the staff (that is, a position desired for increasing or decreasing the volume level of the voice of the order placer that is output from loudspeaker device 37 or headset Hds) on the image displayed on display device 36 (for example, the image captured by camera device Cm) and outputs the coordinates data to signal processor 33. Signal processor 33 causes communicator 31 to transmit the coordinates data obtained from operator 32 to camera device Cm.

Signal processor 33, for example, is configured by using a central processing unit (CPU), a micro processing unit (MPU), or a digital signal processor (DSP) and performs a control process for generally managing operations of each unit in communication system master machines 10 and 10A, a data input-output process between signal processor 33 and other various units, a data operation (calculation) process, and a data storage process.

Sound collecting direction processor 34*a* sets and adjusts the direction in which the main beam (main lobe) of the directivity of the sound collected by microphone array device Mca is formed (hereinafter, referred to as a "sound collecting direction") and, for example, sets a direction corresponding to a predetermined reference beam (direction of a reference beam) as the sound collecting direction (refer to FIG. 5A). The direction of a predetermined reference beam, for example, is the front direction of order post Op or is a direction toward the speaker (order placer) in vehicle CR stopped at a predetermined position (for example, stop line Spn illustrated in FIG. 1) from order post Op.

Sound collecting direction processor 34*a* forms a plurality of search beams at each predetermined angle in any of a horizontal direction from the direction of the reference beam, a vertical direction therefrom, and horizontal and vertical directions therefrom (refer to FIG. 5A to FIG. 5D). The search beam, for example, is a directional main beam that is formed to search for the direction of the sound source of the voice of the speaker (order placer) in vehicle CR from microphone array device Mca by comparing signal strengths (signal-to-noise (SN) ratio).

Sound collecting direction processor 34*a* uses sound data of the sound collected by microphone array device Mca to specify the engine noise direction of vehicle CR stopped at a predetermined position from microphone array device Mca. It is considered that the average value of the acoustic pressure in a surrounding area including vehicle CR is dominantly determined by the average value of the acoustic pressure due to the sound of the engine when vehicle CR is idle after being stopped at a predetermined position. Therefore, sound collecting direction processor 34*a*, for example, specifies the direction corresponding to the search beam that has the greatest average value (observed value) of the acoustic pressure corresponding to each search beam among the plurality of search beams formed at each predetermined angle as the engine noise direction of vehicle CR.

Sound collecting direction processor 34*a* may specify the direction corresponding to the search beam that has the greatest level of stationary noise as the engine noise direction by comparing the levels of stationary noise for each search beam between the plurality of search beams instead of comparing the average value of the acoustic pressure.

Figure 6A:
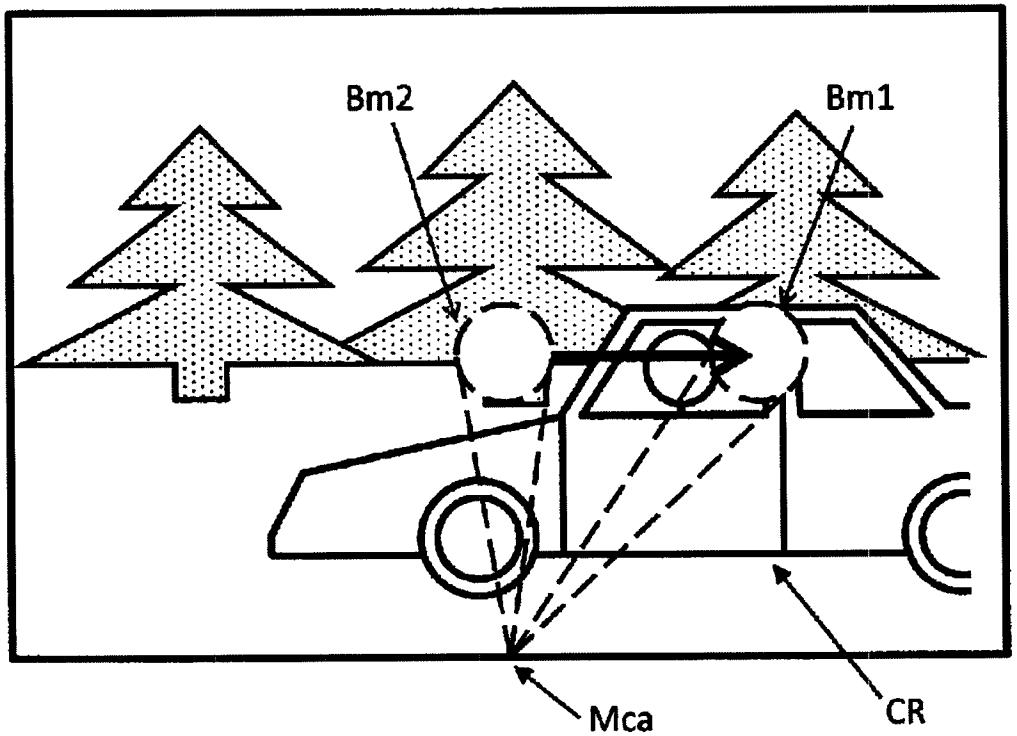
FIG. 6A is a descriptive diagram of switching a sound collecting direction when a reference beam is in an engine noise direction.

Sound collecting direction processor 34*a* switches the sound collecting direction to the direction corresponding to the search beam other than in the engine noise direction when the direction of the engine noise of vehicle CR (engine noise direction) that is specified by sound collecting direction processor 34*a* matches the sound collecting direction corresponding to the reference beam after the stopping of vehicle CR at a predetermined position is detected (refer to FIG. 6A). The direction corresponding to the search beam other than in the engine noise direction, for example, is the direction corresponding to the search beam having the most favorable SN ratio (that is, having the lowest noise level) among the plurality of search beams.

Figure 6B:
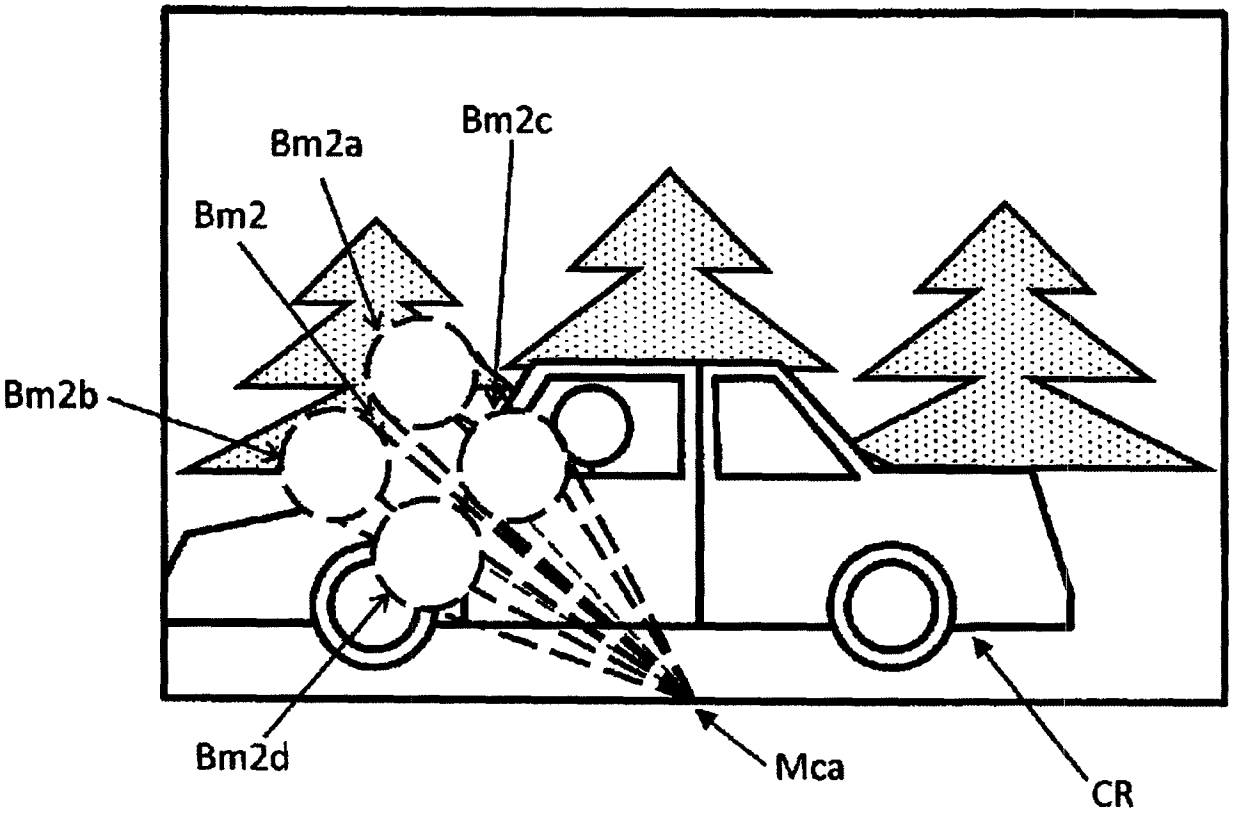
FIG. 6B is a descriptive diagram of adding a plurality of search beams around the engine noise direction.

Sound collecting direction processor 34*a* forms a plurality of search beams in the engine noise direction and around the engine noise direction so as to search for the sound source of the voice of the speaker in the vehicle after the section in which the order placer speaks is detected (refer to FIG. 6B). Sound collecting direction processor 34*a* switches the sound collecting direction to the direction corresponding to any of the plurality of search beams selected by SN comparison processor 34*c*.

Sound collecting direction processor 34*a* uses the distance data and the direction data transmitted from camera device Cm to compute coordinates $\theta_{MAh}$, $\theta_{MAv}$) according to an operation by the staff specifying a position on the image displayed on display device 36. The coordinates ($\theta_{MAh}$, $\theta_{MAv}$) indicate the sound collecting direction toward the sound collecting position (for example, the position of speaker (order placer) HM illustrated in FIG. 5A) corresponding to the specified position from microphone array device Mca. A specific computation method of sound collecting direction processor 34*a* is a known technology and thus will not be described in detail.

The direction (the horizontal angle and the vertical angle) from camera device Cm to the sound collecting position can be used as the coordinates ($\theta_{MAh}$, $\theta_{MAv}$) of the sound collecting direction from microphone array device Mca to the sound collecting position when, for example, the casing of microphone array device Mca is integrated with camera device Cm to surround the casing of camera device Cm. When the casing of camera device Cm and the casing of microphone array device Mca are separately installed, sound collecting direction processor 34*a* computes the coordinates ($\theta_{MAh}$, $\theta_{MAv}$) of the sound collecting direction from microphone array device Mca to the sound collecting position by using pre-computed calibration parameter data and the direction (the horizontal angle and the vertical angle) data from camera device Cm to the sound collecting position. Calibration is an operation of computing or obtaining a predetermined calibration parameter that is required by sound collecting direction processor 34*a* of communication system master machine 10 so as to compute the coordinates ($\theta_{MAh}$, $\theta_{MAv}$) indicating the sound collecting direction. Calibration is performed in advance by using a known technology.

Of the coordinates ($\theta_{MAh}$, $\theta_{MAv}$) indicating the sound collecting direction, $\theta_{MAh}$ represents the horizontal angle of the sound collecting direction from microphone array device Mca toward the sound collecting position, and $\theta_{MAv}$ represents the vertical angle of the sound collecting direction from microphone array device Mca toward the sound collecting position. The sound collecting position is the actual position of the speaker (order placer) in vehicle CR that corresponds to the specified position in the operator 32 specified by a finger of the staff or a stylus pen on the image displayed on display device 36 (refer to FIG. 9).

Figure 9:
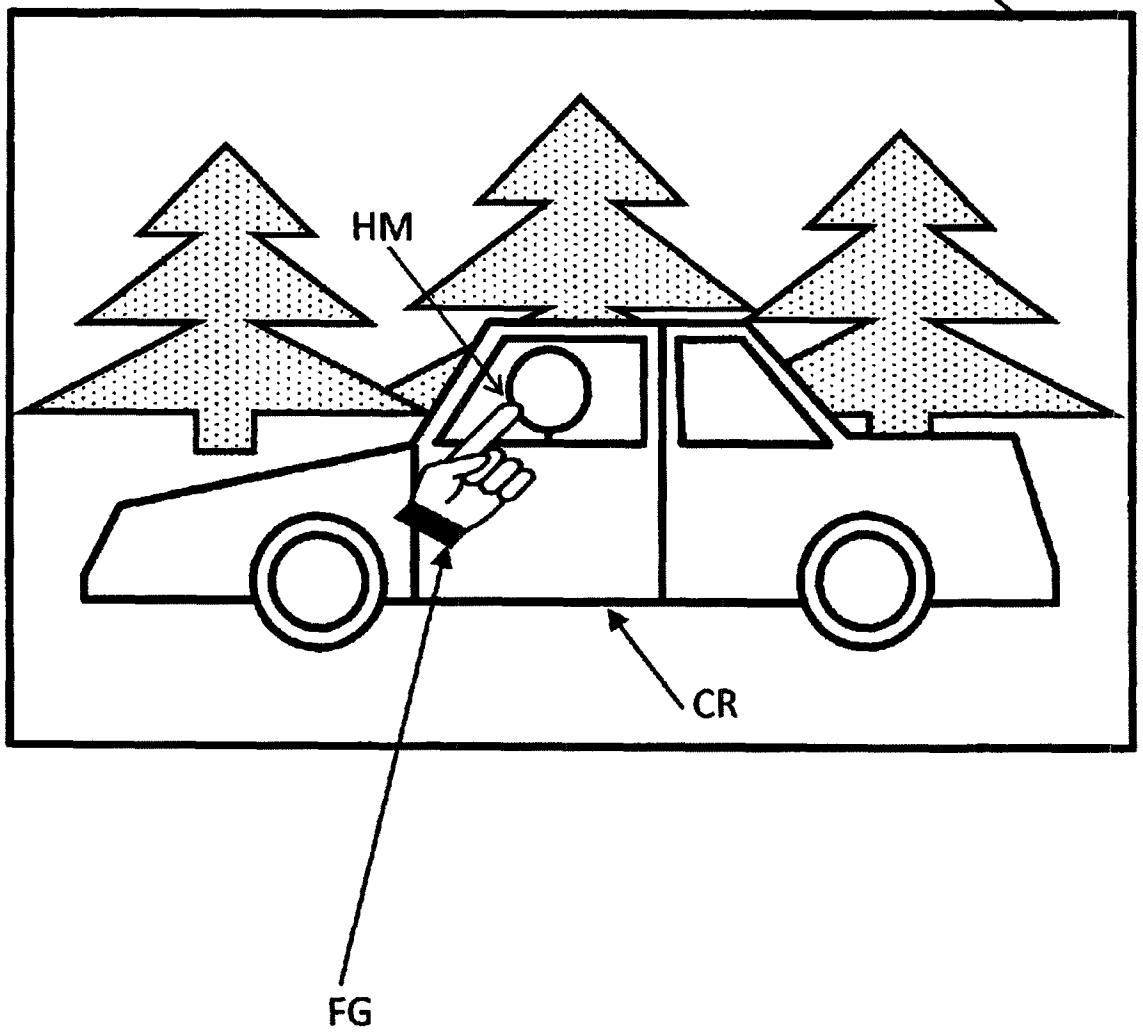
FIG. 9 is a descriptive diagram of switching the sound collecting direction in accordance with a position specified in an image displayed on a display device.

FIG. 9 is a descriptive diagram of switching the sound collecting direction in accordance with the position specified in the image displayed on display device 36. As will be described later with reference to FIG. 7, sound collecting direction processor 34*a* switches and sets the sound collecting direction in FIG. 9. When the staff clicks (touches) the area of the mouth of the speaker (an order placer or a driver) on the image displayed on display device 36, sound collecting direction processor 34*a*, as an auxiliary means for easily correcting (adjusting) the set sound collecting direction, may switch the sound collecting direction to the direction from microphone array device Mca toward the sound collecting position corresponding to the clicked position.

Output controller 34*b* controls operation of display device 36 and loudspeaker device 37. Output controller 34*b*, for example, causes the image data transmitted from camera device Cm to be displayed on display device 36 and causes the sound data transmitted from microphone array device Mca to be output from loudspeaker device 37 according to an operation by the staff. Output controller 34*b* as an example of a directivity former forms directivity of the sound data of the sound collected by microphone array device Mca in the sound collecting direction that the coordinates ($\theta_{MAh}$, $\theta_{MAv}$) computed by sound collecting direction processor 34*a* indicate. Microphone array device Mca itself may form the directivity of the sound data.

A process performed by output controller 34*b* to form the directivity of sound in the direction of a predetermined angle is a known technology and thus will not be described. Output controller 34*b*, for example, applies a delay time that corresponds to the difference of arrival times of the sound signals input to each microphone element from the sound source to the sound signal that the plurality of microphone elements arranged in microphone array device Mca collects by using, for example, a delay sum method. Furthermore, output controller 34*b* forms the directivity of the sound in the direction of a predetermined angle from microphone array device Mca by combining the sound signals after each delay time is applied.

SN comparison processor 34*c* as an example of a search beam selector selects, among the plurality of search beams formed by sound collecting direction processor 34*a*, the search beam having the most favorable SN ratio from the result of comparison of the signal strengths (SN ratios) among the plurality of search beams as the search beam corresponding to the direction of the sound source of the voice of the speaker (order placer) in vehicle CR after the section in which the order placer speaks is detected.

Speaking section determiner 34*d* uses the sound data of the sound collected by microphone array device Mca to detect the section in which the speaker (order placer) speaks in vehicle CR.

Vehicle stop determiner 35 as an example of a vehicle stop detector determines whether vehicle CR is stopped at a predetermined position or vehicle CR is not stopped at a predetermined position on the basis of the detection signal transmitted from vehicle detection sensor CRs. Vehicle stop determiner 35 outputs the detection result to signal processor 33.

Display device 36 as a display is configured by using, for example, an LCD or an organic EL and displays the image data transmitted from camera device Cm on the screen according to an operation by the staff under control of output controller 34*b*. In addition, display device 36 displays a predetermined application screen (for example, refer to FIG. 10) on the screen according to an operation by the staff on the basis of an operating signal that is output from operator 32 so as to, for example, support input of an order from the order placer in the drive-through.

Loudspeaker device 37 as a sound output outputs the sound data transmitted from microphone array device Mca or the sound data of which the directivity is formed in the sound collecting direction ($\theta_{MAh}$, $\theta_{MAv}$) that sound collecting direction processor 34*a* computes. Loudspeaker device 37 may be a loudspeaker device installed in the store or may be a loudspeaker device disposed in headset Hds that the staff wears or may be both thereof. Display device 36 and loudspeaker device 37 may be configured separately from communication system master machine 10.

Memory 38 as a storage is configured by using, for example, a random access memory (RAM). Memory 38 functions as a work memory at the time of operation of each unit in communication system master machine 10. Furthermore, memory 38 stores data that is required at the time of operation of each unit in communication system master machine 10.

Image processor 39 detects the face of the speaker (order placer) in the image displayed on display device 36 by performing predetermined image processing on the image captured by camera device Cm. Furthermore, image processor 39 detects the direction of the reference beam and the front direction of order post Op. Image processor 39 outputs the image processing result to signal processor 33.

In FIG. 4, communication system master machine 10A corresponds to communication system master machine 10 illustrated in FIG. 3 and is configured to include communicator 31A and signal processing device 20. In other words, signal processing device 20 illustrated in FIG. 4 is configured of each unit other than communicator 31 in communication system master machine 10 illustrated in FIG. 3. Thus, signal processing device 20 will not be described.

Figure 5B:
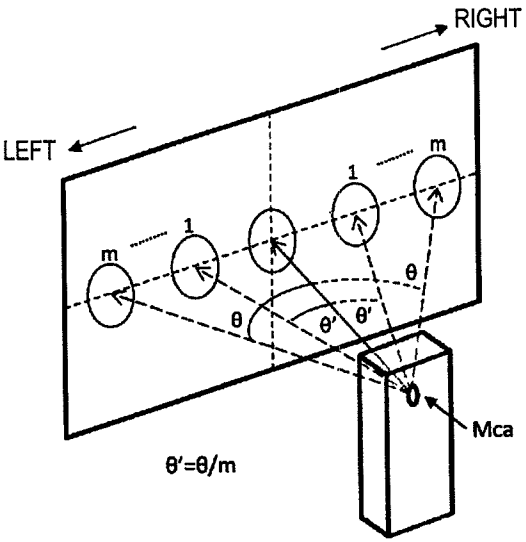
FIG. 5B is a descriptive diagram of forming a plurality of search beams along a horizontal direction.
Figure 5A:
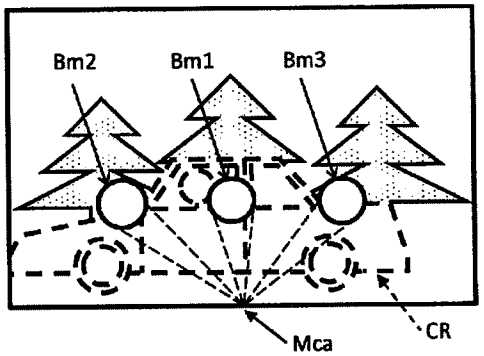
FIG. 5A is a descriptive diagram of forming a plurality of search beams before detecting stopping of a vehicle.
Figure 5D:
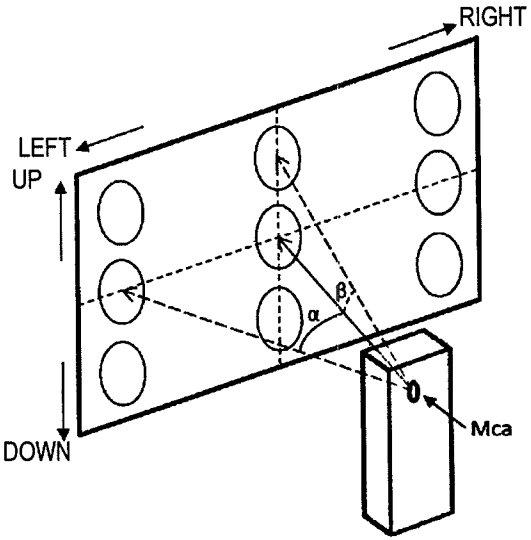
FIG. 5D is a descriptive diagram of forming a plurality of search beams along horizontal and vertical directions.
Figure 5C:
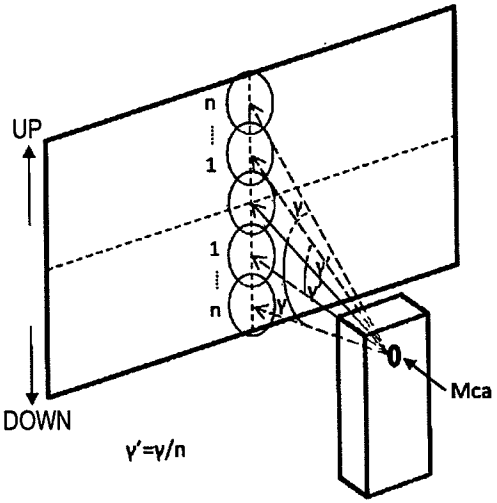
FIG. 5C is a descriptive diagram of forming a plurality of search beams along a vertical direction.

FIG. 5A is a descriptive diagram of forming a plurality of search beams Bm1, Bm2, and Bm3 before detecting stopping of vehicle CR. FIG. 5B is a descriptive diagram of forming a plurality of search beams along a horizontal direction. FIG. 5C is a descriptive diagram of forming a plurality of search beams along a vertical direction. FIG. 5D is a descriptive diagram of forming a plurality of search beams along horizontal and vertical directions.

Sound collecting direction processor 34*a*, before stopping of vehicle CR is detected, forms a predetermined reference beam Bm1 as the sound collecting direction in which the main beam of the directivity of the sound collected by microphone array device Mca is formed (refer to FIG. 5A). In addition, sound collecting direction processor 34*a*, before stopping of vehicle CR is detected, forms a plurality of search beams (for example, search beams Bm2 and Bm3) at each predetermined angle (θ' in the horizontal direction and γ' in the vertical direction) from the direction of the reference beam (refer to FIG. 5A to FIG. 5D).

In FIG. 5B, angle θ is the range of an angle between m (numbers of) search beams that are formed toward the horizontal left direction or toward the horizontal right direction from the front direction of order post Op. Angle θ' is the angle between adjacent search beams in the horizontal left direction or in the horizontal right direction and corresponds to angular resolving power for search beams.

In FIG. 5C, angle γ is the range of an angle between n (numbers of) search beams that are formed toward the vertical upward direction or toward the vertical downward direction from the front direction of order post Op. Angle γ' is the angle between adjacent search beams in the vertical upward direction or in the vertical downward direction and corresponds to angular resolving power for search beams.

Sound collecting direction processor 34*a*, for example, forms (2m+1) (numbers of) search beams in the horizontal direction (left-right direction) (refer to FIG. 5B) and forms (2n+1) (numbers of) search beams in the vertical direction (up-down direction) (refer to FIG. 5C). In addition, sound collecting direction processor 34*a* forms a total (2m+1)×(2n+1) (numbers of) search beams when forming search beams in the horizontal direction (left-right direction) and in the vertical direction (up-down direction) (refer to FIG. 5D). In FIG. 5D, m and n are one, θ is α, and γ is β. In FIG. 5D, angle α is the angle between adjacent search beams in the horizontal left direction or in the horizontal right direction, and angle β is the angle between adjacent search beams in the vertical upward direction or in the vertical downward direction.

FIG. 6A is a descriptive diagram of switching the sound collecting direction when the reference beam is in the engine noise direction. Since the voice uttered by the speaker (order placer) is output to headset Hds of the staff, the sound of which the directivity is formed in the engine noise direction is output to headset Hds when the engine noise direction matches the sound collecting direction corresponding to the reference beam, and the staff may have difficulty in listening to the uttered voice of the speaker (order placer).

In order to avoid the above difficulty, sound collecting direction processor 34*a* switches the sound collecting direction to the direction corresponding to the search beam (for example, search beam Bm1 illustrated in FIG. 6A) other than in the engine noise direction when the direction of the engine noise of vehicle CR (engine noise direction) matches the sound collecting direction corresponding to the reference beam (for example, search beam Bm2 illustrated in FIG. 6A) before the speaker (order placer) speaks (for example, says the order content) after the stopping of vehicle CR at a predetermined position is detected (refer to FIG. 6A).

FIG. 6B is a descriptive diagram of adding a plurality of search beams around the engine noise direction. Since it is considered that the speaker (order placer) is near the engine of vehicle CR in most cases, sound collecting direction processor 34*a* forms a plurality of search beams Bm2*a*, Bm2*b*, Bm2*c*, and Bm2*d* in the search beam Bm2 corresponding to the engine noise direction and around search beam Bm2 corresponding to the engine noise direction so as to search for the sound source of the voice of the speaker in vehicle CR after the section in which the order placer speaks is detected (refer to FIG. 6B).

Figure 7:
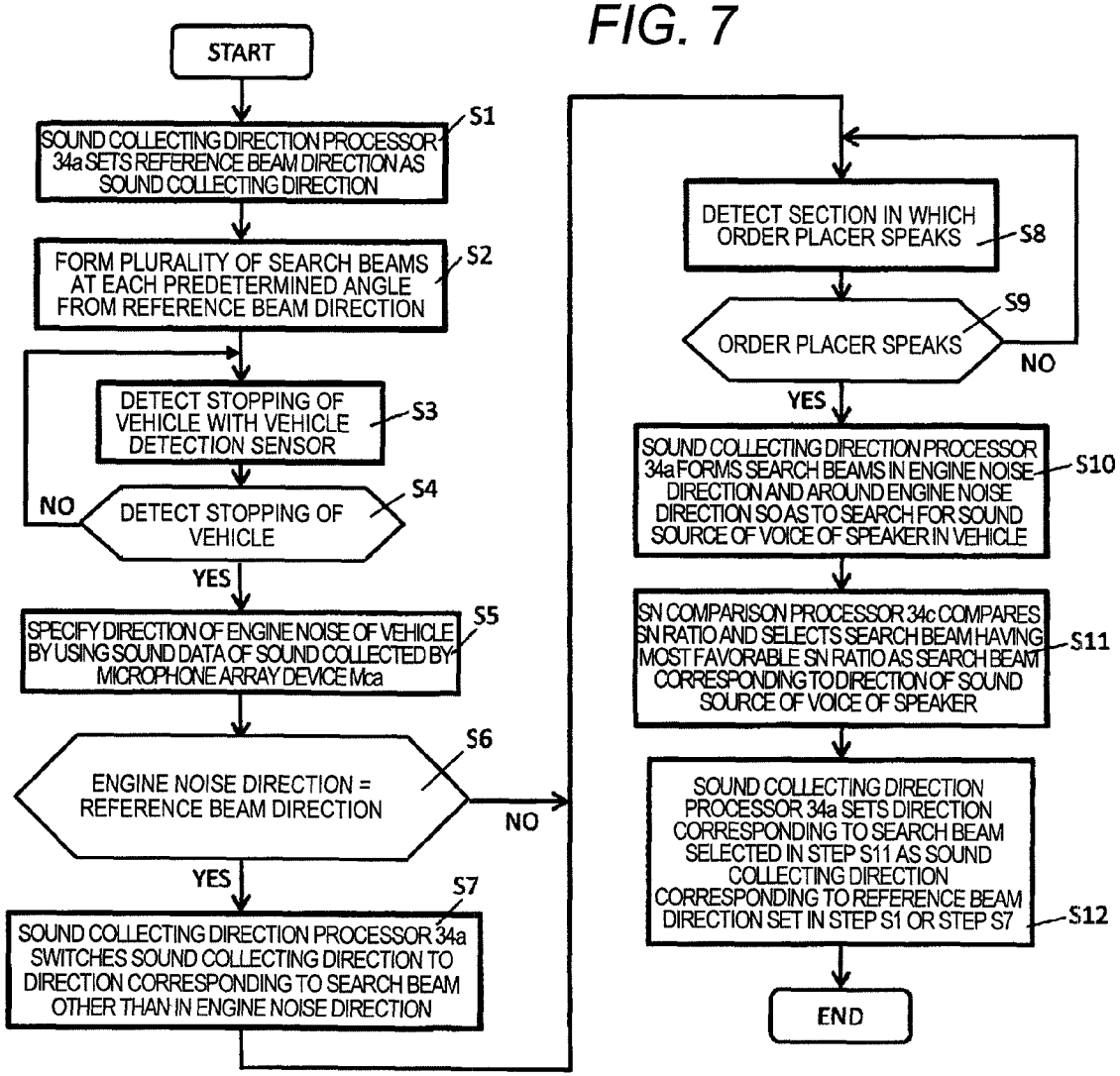
FIG. 7 is a flowchart of an example of an operational procedure in the sound collecting system of the embodiment.

Next, an operational procedure in sound collecting system 100 of the present exemplary embodiment will be described with reference to FIG. 7. FIG. 7 is a flowchart of an example of an operational procedure in sound collecting system 100 of the present exemplary embodiment. In FIG. 7, each process of step S1 to step S7 is performed before the speaker (order placer) in vehicle CR speaks, and each process of step S8 and after is performed while the speaker (order placer) in vehicle CR speaks. Although not illustrated in FIG. 7, the sound of which the directivity is formed in the sound collecting direction that is set by sound collecting direction processor 34*a* is output to headset Hds of staff.

In FIG. 7, sound collecting direction processor 34*a*, for example, sets the direction corresponding to a predetermined reference beam (direction of the reference beam) as the direction in which the main beam of the directivity of the sound collected by microphone array device Mca is formed (sound collecting direction) (refer to S1 and FIG. 5A). Sound collecting direction processor 34*a* forms a plurality of search beams at each predetermined angle in any of a horizontal direction from the direction of the reference beam that is set in step S1, a vertical direction therefrom, and horizontal and vertical directions therefrom (refer to S2 and FIG. 5A to FIG. 5D).

Vehicle detection sensor CRs, after step S2 is performed, detects vehicle CR arriving at the drive-through of the store where sound collecting system 100 is installed and being stopped at a predetermined position (for example, stop line Spn illustrated in FIG. 1) outside the store (S3). When stopping of vehicle CR is detected (YES in S4), sound collecting direction processor 34*a* uses the sound data of the sound collected by microphone array device Mca to specify the engine noise direction of vehicle CR stopped at a predetermined position (S5). For example, sound collecting direction processor 34*a*, for example, specifies the direction corresponding to the search beam that has the greatest average value (observed value) of the acoustic pressure corresponding to each search beam among the plurality of search beams formed at each predetermined angle as the engine noise direction of vehicle CR.

The process proceeds to step S8 when the direction of the reference beam set in step S1 does not match the engine noise direction specified in step S5 (NO in S6). Meanwhile, when the direction of the reference beam set in step S1 matches the engine noise direction specified in step S5 (YES in S6), sound collecting direction processor 34*a* switches the sound collecting direction to the direction corresponding to the search beam other than in the engine noise direction specified in step S5 (refer to S7 and FIG. 6A).

The speaker (order placer) in vehicle CR starts saying the order content, and the voice of the speaker (order placer) in the section in which the speaker speaks is determined by speaking section determiner 34*d* (S8) after step S7 is performed. When the speaker speaks (for example, says the order content) (YES in S9), sound collecting direction processor 34*a* forms a plurality of search beams in the engine noise direction and around the engine noise direction so as to search for the sound source of the voice of the speaker in the vehicle (refer to S10 and FIG. 6B).

SN comparison processor 34*c* compares the SN ratio as an example of an index of a signal strength between the plurality of search beams formed in step S10 including the search beam corresponding to the engine noise direction. SN comparison processor 34*c* selects the search beam having the most favorable SN ratio as the search beam corresponding to the direction of the sound source of the voice of the speaker (order placer) in vehicle CR (S11). Sound collecting direction processor 34*a* sets the direction corresponding to the search beam selected by SN comparison processor 34*c* in step S11 as the sound collecting direction corresponding to the direction of the reference beam set in step S1 or step S7 (S12).

Figure 8:
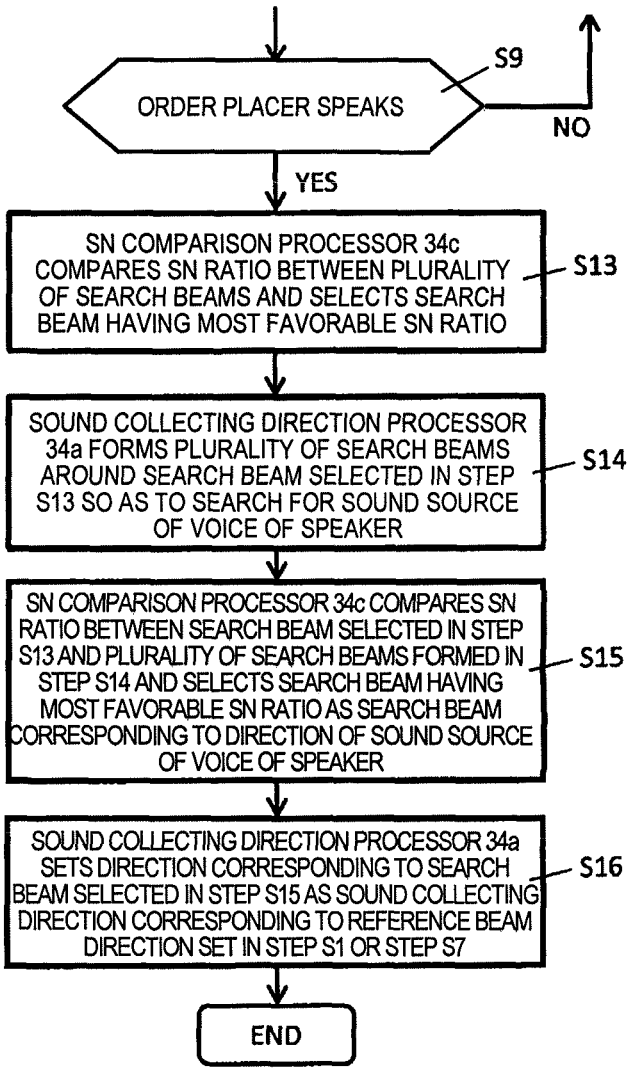
FIG. 8 is a flowchart of another example of the operational procedure in the sound collecting system of the embodiment.

FIG. 8 is a flowchart of another example of the operational procedure in sound collecting system 100 of the present exemplary embodiment. For easy understanding of the differences between FIG. 7 and FIG. 8, duplicate processes of each process illustrated in FIG. 7 are not illustrated in FIG. 8. Specifically, the processes of step S1 to step S8 are not illustrated.

In FIG. 8, when the speaker speaks (for example, says the order content) (YES in S9), SN comparison processor 34*c* compares the SN ratio between the plurality of search beams and selects the search beam having the most favorable SN ratio from the plurality of search beams that is formed at each predetermined angle in any of the horizontal direction, the vertical direction, and the horizontal and vertical directions in step S2 (S13). Sound collecting direction processor 34*a* forms a plurality of search beams around the search beam selected in step S13 so as to search for the sound source of the voice of the speaker in the vehicle (refer to S14 and FIG. 6B).

SN comparison processor 34*c* compares the SN ratio as an example of the index of a signal strength between the search beam selected in step S13 and the plurality of search beams formed in step S14 and selects the search beam having the most favorable SN ratio as the search beam corresponding to the direction of the sound source of the voice of the speaker (order placer) in vehicle CR (S15). Sound collecting direction processor 34*a* sets the direction corresponding to the search beam selected by SN comparison processor 34*c* in step S15 as the sound collecting direction corresponding to the direction of the reference beam set in step S1 or step S7 (S16).

Figure 10:
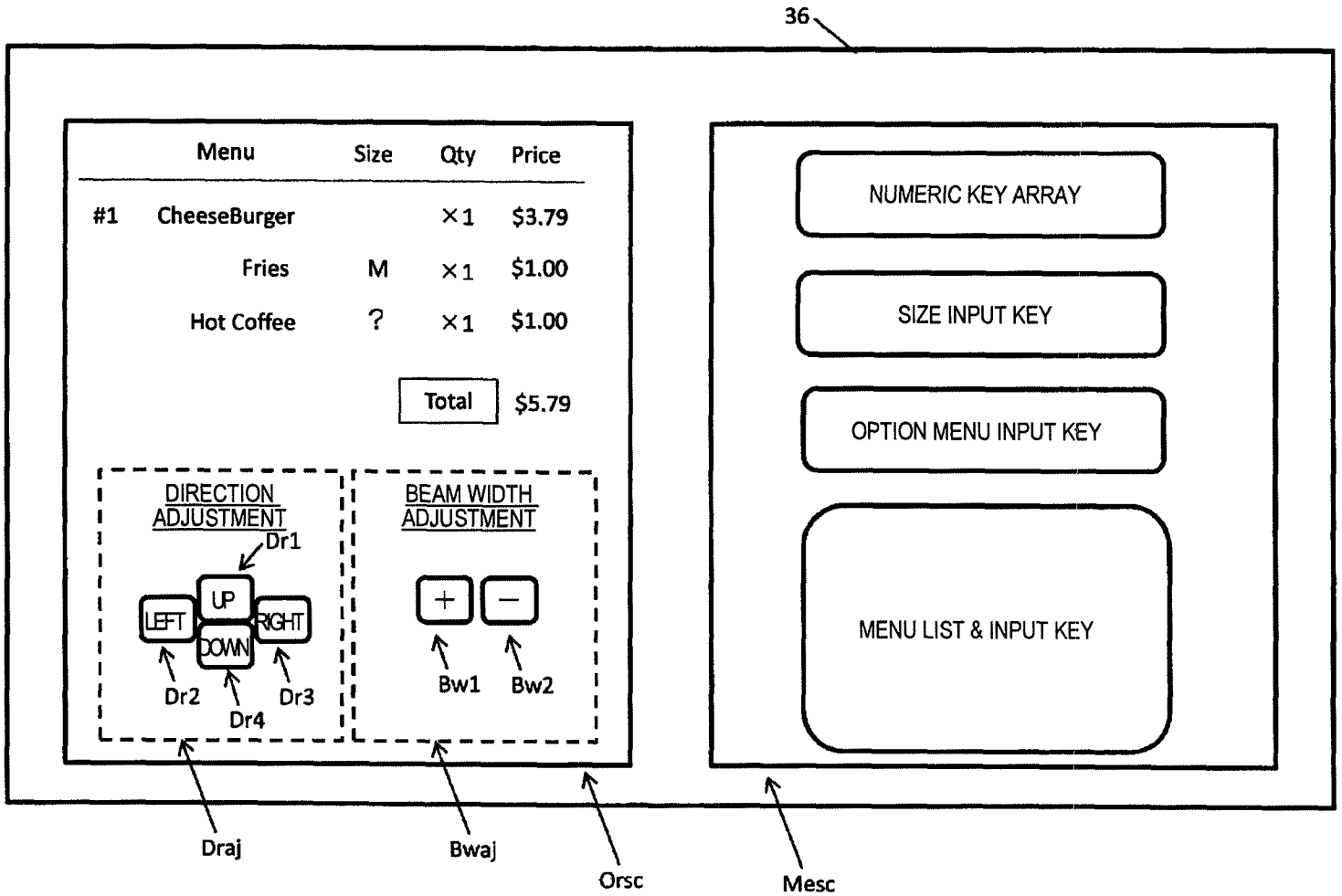
FIG. 10 is a diagram of an example of an operational screen related to an adjustment of the sound collecting direction and an adjustment of the width of a search beam.

FIG. 10 is a diagram of an example of an operational screen related to an adjustment of the sound collecting direction and an adjustment of the width of a search beam. As described with reference to FIG. 7 or FIG. 8, sound collecting direction processor 34*a* sets the sound collecting direction in which the directivity of the sound output from headset Hds that the staff wears is formed. The staff, for example, may arbitrarily adjust the sound collecting direction or the width of the reference beam by operating direction adjustment menu Draj and beam width adjustment menu Bwaj in order display screen Orsc of an operating screen that is displayed on display device 36.

In FIG. 10, order display screen Orsc and order input operating screen Mesc are displayed on display device 36, and direction adjustment menu Draj and beam width adjustment menu Bwaj are displayed in order display screen Orsc. In direction adjustment menu Draj, four adjusting buttons (upward direction adjusting button Dr1, left direction adjusting button Dr2, right direction adjusting button Dr3, and downward direction adjusting button Dr4) are displayed so as to adjust the angles of the sound collecting direction. In beam width adjustment menu Bwaj, two adjusting buttons (plus adjusting button Bw1 and minus adjusting button Bw2) are displayed so as to adjust the width of the reference beam corresponding to the sound collecting direction. The staff can easily adjust the angles of the sound collecting direction or can easily adjust the width of the reference beam corresponding to the sound collecting direction by arbitrarily operating (touching, clicking, or the like) each adjusting button.

In sound collecting system 100 of the present exemplary embodiment, according to the description above, communication system master machine 10 as an example of the sound collecting control apparatus according to the present disclosure forms a plurality of search beams in the direction of the noise source (for example, sound of the engine) of vehicle CR and around the direction of the noise source of vehicle CR so as to search for the sound source of the voice of the speaker in vehicle CR, selects the search beam corresponding to the sound source of the voice of the speaker in vehicle CR from the plurality of search beams, and forms the directivity of the sound in the direction corresponding to the selected search beam.

Communication system master machine 10, accordingly, forms the directivity of the sound collected by microphone array device Mca in the direction of the speaker in vehicle CR. Thus, it is possible to suppress a decrease in the accuracy of collecting the voice of the speaker in comparison with sound collected by using a single directional microphone or a non-directional microphone as in the related art, and it is possible to facilitate listening to the order content of the speaker by the staff in the store wearing the headset that outputs sound having directivity.

Communication system master machine 10, in addition, additionally forms a plurality of search beams after selecting the search beam (for example, the search beam having the most favorable SN ratio) corresponding to the sound source of the voice of the speaker (for example, the order placer) in vehicle CR from a plurality of search beams formed in the direction of the noise source of vehicle CR including the direction of the noise source by using the fact that the speaker (for example, the order placer) is usually near the noise source of vehicle CR and using the direction of the noise source of vehicle CR. Thus, it is possible to accurately select the search beam corresponding to the sound source of the voice of the speaker in vehicle CR.

Communication system master machine 10, in addition, forms a plurality of search beams at each angle smaller than a predetermined angle after selecting the search beam (for example, the search beam having the most favorable SN ratio) corresponding to the sound source of the voice of the speaker (for example, the order placer) in vehicle CR from a plurality of search beams formed in the direction of the reference beam including the direction of the reference beam without using the direction of the noise source of vehicle CR. Thus, it is possible to easily and accurately select the search beam corresponding to the sound source of the voice of the speaker in vehicle CR.

Communication system master machine 10, in addition, forms directivity of sound in the direction of a predetermined reference beam corresponding to the sound source of the voice of the speaker in vehicle CR before vehicle CR stops at a predetermined position outside the store. Thus, it is possible to immediately form directivity of sound in the direction of the sound source of the voice (for example, the order content) of the speaker (for example, the order placer) in vehicle CR when vehicle CR stopped at a predetermined position is detected, and it is possible to increase the accuracy of listening to the order content by the staff in the store.

Communication system master machine 10, in addition, forms a plurality of search beams at each predetermined angle in any of the horizontal direction, the vertical direction, and the horizontal and vertical directions from the direction of the reference beam before vehicle CR stops at a predetermined position outside the store. Thus, it is possible to accurately select the direction of the sound source of the voice (for example, the order content) of the speaker (for example, the order placer) in vehicle CR when vehicle CR stopped at a predetermined position is detected.

Communication system master machine 10, in addition, forms directivity of sound by switching the direction of the reference beam to the direction other than the direction of the noise source of vehicle CR when the direction of the noise source (for example, sound of the engine) of vehicle CR matches the direction of the reference beam. Thus, it is possible to prevent the sound of the noise source (for example, sound of the engine) of vehicle CR being loudly output from the headset that the staff in the store wears.

Communication system master machine 10, in addition, forms directivity of sound by switching the directivity of sound to the direction toward the sound collecting position corresponding to the position specified in the image displayed on display device 36 from microphone array device Mca according to the specification of a position on display device 36 that displays the image of vehicle CR captured by camera device Cm. Thus, it is possible to flexibly change the sound collecting direction corresponding to the directivity of sound that is previously formed to a desired sound collecting direction according to an operation by the user.

Communication system master machine 10, in addition, forms directivity of sound by switching the directivity of sound in correspondence with a sound collecting direction after an adjustment according to an input operation of adjusting the sound collecting direction to one of the horizontal direction and the vertical direction performed on direction adjustment menu Draj. Thus, it is possible to flexibly and easily adjust the sound collecting direction according to, for example, an input operation performed by the user on direction adjustment menu Draj.

Communication system master machine 10, in addition, forms directivity of sound by switching the directivity of sound in correspondence with the width of a beam in the sound collecting direction after an adjustment according to an input operation of adjusting the width of the beam in the sound collecting direction to each predetermined width performed on beam width adjustment menu Bwaj. Thus, it is possible to flexibly and easily adjust the width of the beam in the sound collecting direction according to, for example, an input operation performed by the user on beam width adjustment menu Bwaj.

While various embodiments have been described thus far with reference to the drawings, it is needless to say that the present disclosure is not limited to such examples. It is apparent that those skilled in the related art may perceive various modification examples and correction examples within the scope disclosed in the claims, and it is understood that those modification examples and correction examples apparently fall within the technical scope of the present disclosure.

The present disclosure is useful as the sound collecting control apparatus and the sound collecting system that suppress a decrease in the accuracy of collecting the voice of the speaker and facilitate listening to the order content of the speaker by the staff in the store by forming the directivity of the sound collected by a plurality of microphone elements in the direction of the speaker.

What is claimed is:

1. A sound acquiring control apparatus comprising:

a sensor that detects a vehicle stopped at a predetermined position;

a processor; and a memory storing instructions that, when executed by the processor, cause the processor to perform operations comprising:

forming a plurality of first search beams in a direction of a predetermined reference beam and in directions around the predetermined reference beam, to search for an engine noise source by using a microphone array that includes a plurality of sound acquiring elements and that acquires an outdoor-sound, detecting, by the sensor, the vehicle stopped at the predetermined position, specifying an engine noise beam corresponding to the engine noise source of the vehicle stopped at the predetermined position, of the plurality of the first search beams, based on the specified engine noise beam, forming a plurality of second search beams in a direction of the specified engine noise beam and in directions around the direction of the specified engine noise beam, to search for a sound source of a voice of a person in the vehicle;

selecting a voice beam corresponding to the sound source of the voice of the person in the vehicle, from the plurality of second search beams; and outputting, from an indoor-speaker, the voice of the person in the vehicle acquired by the microphone array using the selected voice beam.

2. The sound acquiring control apparatus of claim 1, wherein the plurality of first search beams are formed before the sensor detects the vehicle stopped at the predetermined position.

3. The sound acquiring control apparatus of claim 1, wherein the plurality of first search beams are formed at first predetermined angles in one of a horizontal direction, a vertical direction, and both the horizontal and vertical directions from the direction of the predetermined reference beam, and the plurality of second search beams are formed at second predetermined angles in one of the horizontal direction, the vertical direction and both the horizontal and vertical directions.

4. The sound acquiring control apparatus of claim 1, wherein, when the direction of the specified engine noise beam matches the direction of the predetermined reference beam, the direction of the predetermined reference beam is switched to a direction of a selected one of the plurality of first search beams other than the specified engine noise beam.

5. The sound acquiring control apparatus of claim 1, wherein the operations further comprising:

receiving a designation of a position on a display that displays an image of the vehicle captured by a camera, and determining the direction of the predetermined reference beam according to the position designated on the display.

6. The sound acquiring control apparatus of claim 1, wherein the operations further comprising:

receiving an input operation of adjusting the direction of the selected voice beam in one of a horizontal direction and a vertical direction, performed on a direction adjustment screen displayed on a display, and adjusting the direction of the selected voice beam according to the input operation performed on the display.

7. The sound acquiring control apparatus of claim 1, wherein the operations further comprising:

receiving an input operation of adjusting a width of at least one of the plurality of first search beams or the plurality of second search beams, performed on a beam width adjustment screen displayed on a display, and adjusting the width of the at least one of the plurality of first search beams or the plurality of second search beams according to the input operation performed on the display.

8. The sound acquiring control apparatus of claim 1, wherein the plurality of second search beams are formed at first predetermined angles in one of a horizontal direction, a vertical direction and both the horizontal and vertical directions, the operations further comprising:

forming a plurality of third search beams at second predetermined angles, smaller than the first predetermined angles, around the selected voice beam, and selecting one of the plurality of third search beams, corresponding to the sound source of the voice of the person in the vehicle.

9. The sound acquiring control apparatus of claim 1, wherein a first search beam of the plurality of first search beams, having the greatest average acoustic pressure, is specified as the engine noise beam.

10. The sound acquiring control apparatus of claim 1, wherein a first search beam of the plurality of first search beams, having the greatest level of stationary noise, is specified as the engine noise beam.

11. The sound acquiring control apparatus of claim 1, wherein the engine noise beam is specified after the sensor detects the vehicle stopped at the predetermined position, and before the person in the vehicle starts talking.

12. The sound acquiring control apparatus of claim 1, wherein the engine noise beam is specified after the sensor detects the vehicle stopped at the predetermined position, and before an indoor-person starts talking.

13. The sound acquiring control apparatus of claim 1, wherein the voice beam is selected after the person in the vehicle starts talking.

14. The sound acquiring control apparatus of claim 1, wherein a second search beam of the plurality of second search beams, having the best S/N ratio is selected as the voice beam.

15. The sound acquiring control apparatus of claim 1, further comprising:

an indoor-microphone that acquires an indoor-sound, including a voice of a person indoors; and an outdoor-speaker that outputs the indoor-sound acquired by the indoor-microphone.

16. A sound acquiring system comprising:

a microphone array that includes a plurality of sound acquiring elements and acquires an outdoor-sound;

an indoor-speaker that outputs the outdoor-sound acquired by the microphone array;

a sensor that detects a vehicle stopped at a predetermined position; and a sound acquiring controller comprising:

a processor; and a memory including instructions that, when executed by the processor, cause the processor to perform operations comprising:

forming a plurality of first search beams in a direction of a predetermined reference beam and in directions around the predetermined reference beam, to search for an engine noise source by using the microphone array, detecting, by the sensor, the vehicle stopped at the predetermined position, specifying an engine noise beam corresponding to the engine noise source of the vehicle stopped at the predetermined position, of the plurality of the first search beams, based on the specified engine noise beam, forming a plurality of second search beams in a direction of the specified engine noise beam and in directions around the direction of the specified engine noise beam, to search for a sound source of a voice of a person in the vehicle;

selecting a voice beam corresponding to the sound source of the voice of the person in the vehicle from the plurality of second search beams; and outputting, from an indoor-speaker, the voice of the person in the vehicle acquired by the microphone array using the selected voice beam.

17. The sound acquiring system of claim 16, wherein the plurality of second search beams are formed at first predetermined angles in one of a horizontal direction, a vertical direction and both the horizontal and vertical directions, the processor further performs operations comprising:

forming a plurality of third search beams at second predetermined angles, smaller than the first predetermined angles, around the selected voice beam, and selecting one of the plurality of third search beams, corresponding to the sound source of the voice of the person in the vehicle.

* * * * *